US005406994A

United States Patent [19]

Mitchell et al.

[11] Patent Number: 5,406,994

[45] Date of Patent: Apr. 18, 1995

[54] PORTABLE GASOLINE CONTAINER

[75] Inventors: Robert K. Mitchell, Brookfield; John H. Thiermann, Milwaukee, both of Wis.

[73] Assignee: Briggs & Stratton Corporation, Wauwatosa, Wis.

[21] Appl. No.: 288,436

[22] Filed: Aug. 10, 1994

Related U.S. Application Data

[63] Continuation of Ser. No. 918,978, Jul. 24, 1992, abandoned.

[51] Int. Cl.[6] ..... B65B 1/30; B65B 3/28

[52] U.S. Cl. ..... 141/198; 141/291; 141/303; 141/307; 220/662; 220/663; 222/566

[58] Field of Search ..... 220/563, 367, 663, 662, 220/731, 747, 746, 745, 772, 771, 768, 86.2, 86.1; 222/464, 478, 479, 566, 567, 568, 569, 570, 571, 523, 522, 465.1, 466, 468; 215/1 C, 100 A; 141/291, 293, 303, 307, 198, 94

[56] References Cited

U.S. PATENT DOCUMENTS

| | | | |
|---|---|---|---|
| 3,000,544 | 9/1961 | Roberts | 222/479 |
| 3,214,052 | 10/1965 | Dike | 215/100 A |
| 3,384,276 | 5/1968 | Henningfield | 222/479 |
| 3,834,594 | 9/1974 | Schiemann | 222/479 |
| 4,133,287 | 1/1979 | Downs . | |
| 4,166,431 | 9/1979 | Pickering . | |
| 4,213,536 | 7/1980 | Häfner | 220/663 |
| 4,335,167 | 6/1982 | Kolditz . | |
| 4,412,633 | 11/1983 | Guerrazzi et al. | 215/100 A |
| 4,588,111 | 5/1986 | Hestehave | 222/568 X |
| 4,595,030 | 6/1986 | Yazaki . | |
| 4,667,710 | 5/1987 | Wu | 141/198 |
| 4,819,833 | 4/1989 | Huddleston et al. . | |
| 4,830,212 | 5/1989 | Nagashima et al. . | |
| 4,834,151 | 5/1989 | Law | 141/198 |
| 4,838,464 | 6/1989 | Briggs | 222/478 |
| 4,848,602 | 7/1989 | Yoshimura et al. . | |
| 4,856,685 | 8/1989 | Gaffney . | |
| 4,928,860 | 5/1990 | Knight | 220/772 X |
| 4,987,777 | 1/1991 | Bourret et al. . | |
| 5,114,028 | 5/1992 | Ring | 215/100 A |
| 5,228,487 | 7/1993 | Thiermann et al. | 141/291 |

FOREIGN PATENT DOCUMENTS

| | | | |
|---|---|---|---|
| 2113000 | 9/1972 | Germany | 222/479 |

*Primary Examiner*—Henry J. Recla
*Assistant Examiner*—Steven O. Douglas
*Attorney, Agent, or Firm*—Michael, Best & Friedrich

[57] ABSTRACT

A pour spout for conducting a liquid, such as fuel, from a portable ventless container to a tank which includes a mechanism for enabling a user to readily determine when the tank is full and when fluid flow from the portable container into the tank has stopped. The mechanism includes a window in a wall of the container and a deflector connected to the pour spout which extends into the interior of the container for directing air bubbles entering the container through the pour spout toward the window. The window permits a user to visually determine when the displaced air bubbles stop flowing which is an indication that the tank is full and flow of the liquid has stopped. The window may be in the form of a translucent thin wall section, a transparent pane mounted in the wall, or the container itself may be translucent throughout so that the displaced air bubbles may be seen when directed to a location adjacent a wall. The container also includes a carrying handle and a pouring handle located in such a manner that the center of gravity of the container is located closely adjacent to a vertical line passing through the point of support of a user's hand on the pouring handle during a pouring operation.

21 Claims, 3 Drawing Sheets

FIG. 1
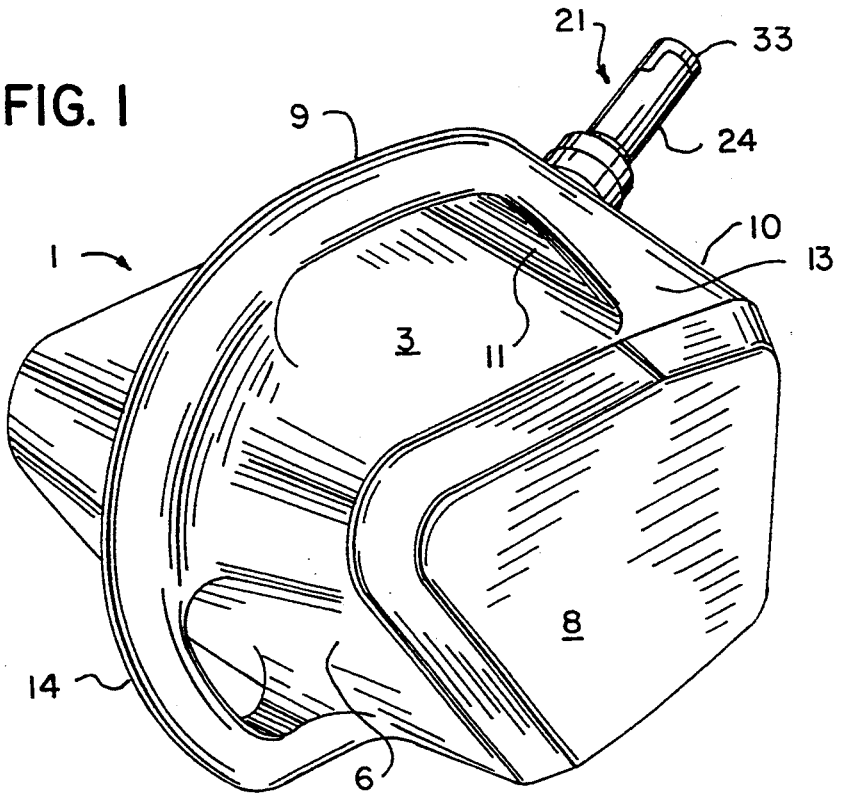
FIG. 7
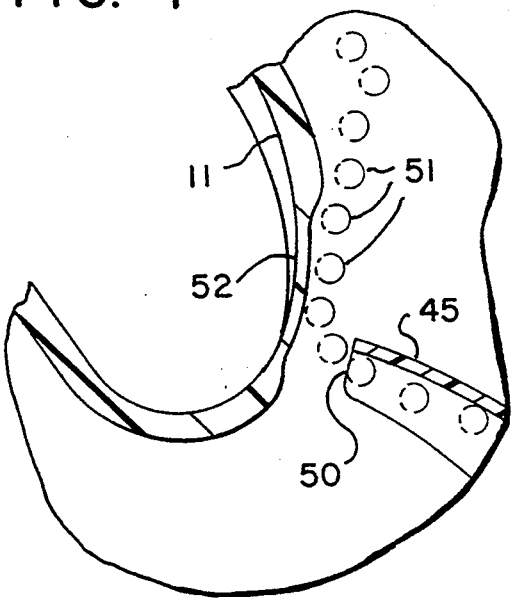
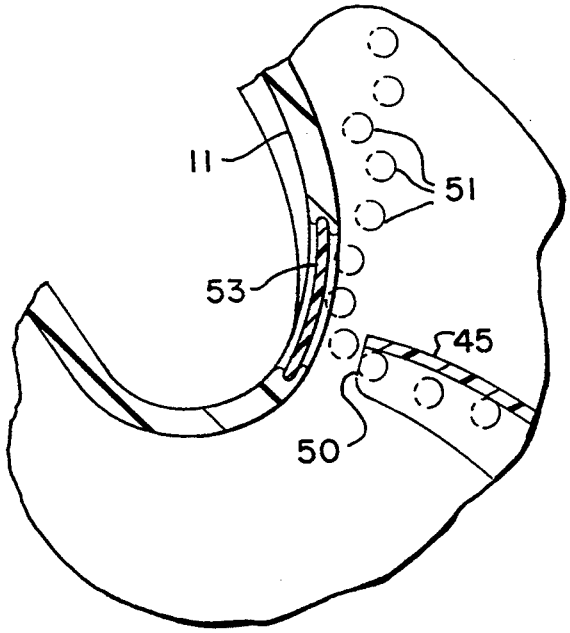
FIG. 8

PORTABLE GASOLINE CONTAINER

This application is a continuation of application Ser. No. 07/918,978 filed Jul. 24, 1992, now abandoned.

BACKGROUND OF THE INVENTION

The present invention relates to portable containers for transporting, storing and dispensing a liquid, and more particularly to a portable gasoline container.

Portable liquid containers, such as those employed to transport, store and dispense gasoline, are utilized in cooperation with a tank associated with an internal combustion engine, as used in a lawnmower, chain saw, snowmobile, generator or the like. In the past, such containers have typically employed vents formed in the reservoir housing to permit the displacement of air during a pouring operation. However, in recent years it has been determined that the escape of vapor from such a container to the atmosphere as the fuel is poured into a tank provides a health, safety and environmental hazard. Accordingly, gasoline containers are now being constructed without a vent formed directly in the reservoir housing. However, since air displacement must still be provided to permit a continuous smooth flow of fuel from the container, various types of pour spouts have been developed which allow for venting of vapor between the container and the tank into which fuel is flowing.

Certain problems, however, are encountered when pouring a liquid fuel such as gasoline from a portable container of the "ventless" type into a tank associated with an internal combustion engine. One problem is that during a pouring operation a user cannot readily recognize when the tank being filled is full of fuel. Although the pouring spouts referred to above typically will automatically shut off when the tank is full, there is no indication to the user of when this occurs. Consequently, a user is constantly withdrawing the pour spout from the neck of the tank being filled to visually observe whether or not the tank is full. This defeats the purpose of automatic shut-off pour spouts which were designed to control and contain gasoline vapors, fuel spillage and evaporative losses during pouring operations.

SUMMARY OF THE INVENTION

The invention is directed to an improved pour spout for conducting a liquid, such as fuel, from a portable container to a tank which includes a mechanism for enabling a user to readily determine when the tank is full and when fluid flow from the portable container into the tank has stopped. This enables a single pouring operation to take place thus limiting the amount of fuel spillage and evaporative losses during the pouring operation.

In order to accomplish the above objective, the present invention provides a window in a wall of the portable container and a deflector connected to the pour spout which extends into the interior of the container for directing air bubbles entering the container through the pour spout toward the window where they can be seen by a user. Thus, a user can visually determine when the displaced air bubbles stop flowing which is an indication that the tank is full and flow of the liquid has stopped. The window may be in the form of a translucent thin wall section, a transparent pane mounted in the wall, or the container itself may be molded from a plastic material such as polypropylene or polyethylene which is transparent or translucent throughout the reservoir housing so that the displaced air bubbles may readily be visually observed when directed to a location adjacent a reservoir wall.

In another aspect of the invention, the container includes a carrying handle connected to the top of the container and a pouring handle connected to the rear of the container in such a manner that the container has a center of gravity which is located closely adjacent to a vertical line passing through the point of support of a user's hand on the pouring handle during a pouring operation. Since the location of the center of gravity of the container is closely adjacent to such a vertical line, the balance of the container is appropriate when pouring liquid from the container into a tank. This balance during a pouring operation also allows an easier view of the pour spout and window.

BRIEF DESCRIPTION OF THE DRAWINGS

The drawings illustrate the best mode presently contemplated of carrying out the invention.

In the drawings:

FIG. 1 is a perspective view of a portable liquid container constructed in accordance with the principles of the present invention;

FIG. 7 is am enlarged fragmentary cross-sectional view illustrating a second embodiment of the window used to visually observe air bubbles; and FIG. 8 is a cross-sectional view similar to FIG. 7 illustrating a third embodiment of the window.

DETAILED DESCRIPTION OF THE PREFERRED EMBODIMENT

Figure 2:
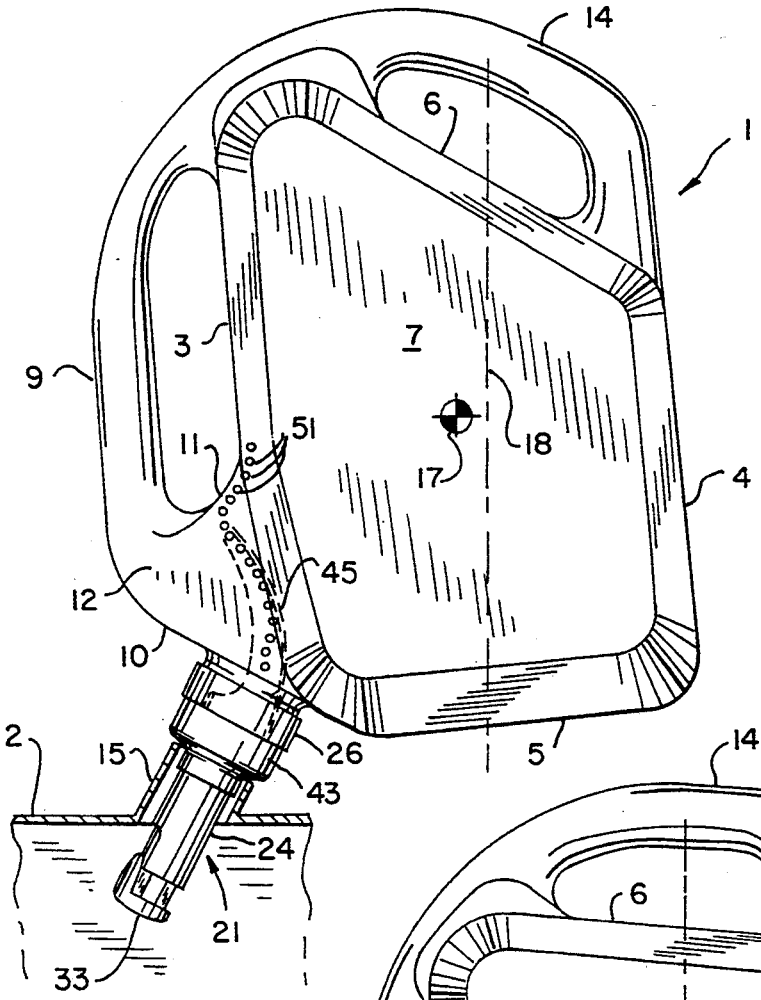
FIG. 2 is a side view in elevation of the container illustrating a pouring operation into a tank with an inclined filler neck.

Referring now to the drawings, FIG. 1 illustrates a portable container generally designated by the numeral 1 for transporting, storing and dispensing a liquid. Container 1 has particular application for use in conducting or pouring liquid fuel, such as gasoline, from container 1 to a tank 2 (see FIGS. 2 and 3) which is associated with an internal combustion engine such as that used in a lawnmower, snowmobile, outboard motor, chain saw, generator or the like.

Figure 3:
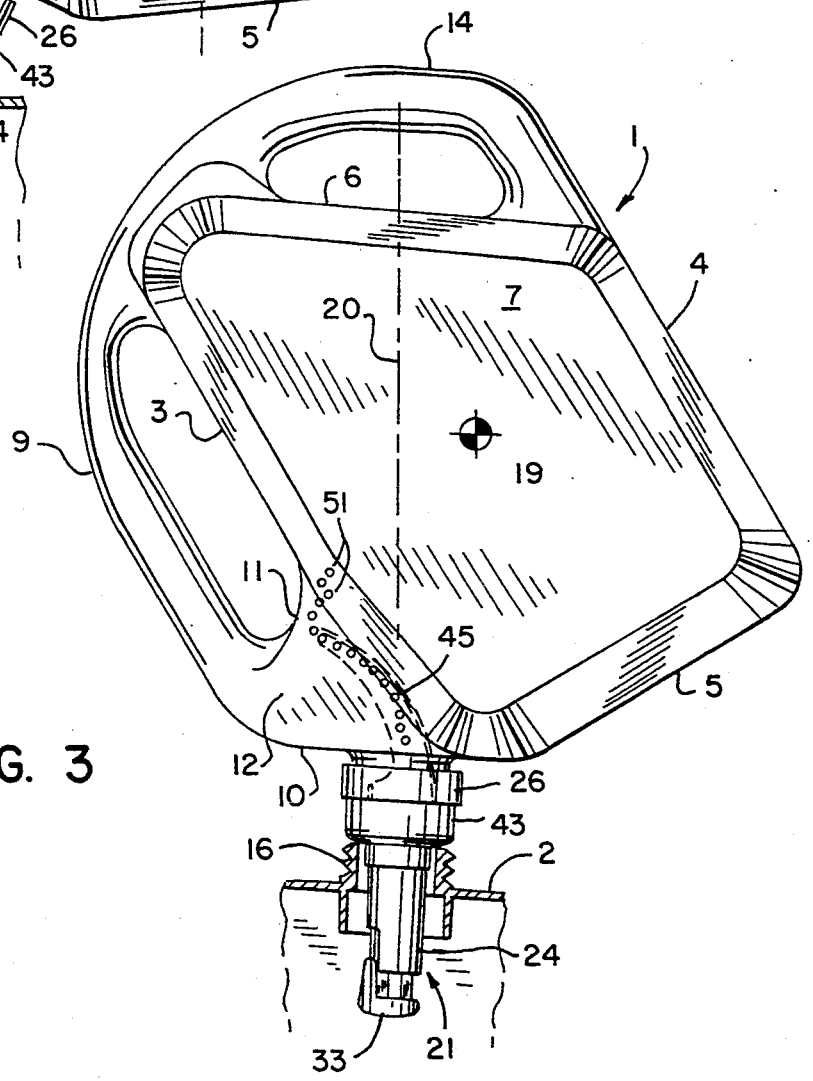
FIG. 3 is a side view in elevation similar to FIG. 2 illustrating the container in a pouring operation into a tank having a vertically extending filler neck.

As shown best in FIGS. 1–3, container 1 includes a top wall 3, a bottom wall 4, a front wall 5, a rear wall 6 and a pair of opposite side walls 7 and 8 forming a hollow reservoir housing which defines a compartment for containing the liquid. Container 1 is composed of any material having walls 3–8 of sufficient thickness and density to contain liquid, such as gasoline. Preferably, however, container 1 is composed of a plastic material such as polypropylene or polyethylene or may be composed of nylon with a reinforcing or strengthening agent such as glass fibers. Such material results in container 1 being transparent or translucent throughout the reservoir body so that the level of liquid therein can be readily observed by a user. However, opaque plastics may also be employed to construct container 1, and as will be described hereinafter, an appropriate "window" may be chosen depending upon the material of construction of container 1.

Container 1 includes a carrying handle 9 having forward and rearward ends integrally connected with top wall 3. The connection of the forward end of handle 9 to the reservoir housing comprises a tapered forward wall 10, a tapered back wall 11 and a pair of opposite tapered end walls 12 and 13 all converging at the forward end of handle 9. It is of particular note that when container 1 is utilized in a pouring operation, as shown best in FIGS. 2 and 3, back wall 11 is in plain view of the user. Container 1 also includes a pouring handle 14 having upper and lower ends integrally connected to rear wall 6 of container 1. It should be noted that the above components are being described when the container 1 is in a normally upright position, as shown in FIG. 1 so that the specific orientation of these components may change during a pouring operation so that the terms "upper", "lower", "forward" and "rearward" are not to be construed as limiting the position or location of these components.

FIGS. 2 and 3 illustrate container 1 being utilized in a pouring operation. More particularly, FIG. 2 illustrates container 1 pouring fluid into tank 2 having a filler neck 15 which is on an axis inclined at an angle of about 30° from a vertical axis. FIG. 3 on the other hand illustrates a pouring operation into tank 2 having a filler neck 16 which is vertically orientated. In FIG. 2, the numeral 17 designates the center of gravity of container 1. As illustrated, the center of gravity 17 of container 1 is only slightly to the left of a vertical line 18 through the point of support of a user's hand on handle 14 during a pouring operation. This would cause container 1 to attempt to rotate only slightly to move toward vertical axis 18. Referring now to FIG. 3 with vertical filler neck 16, numeral 19 designates the center of gravity of container 1. As illustrated, the center of gravity 19 of container 1 is only slightly to the right of a vertical line 20 through the point of support of a user's hand on handle 14 during a pouring operation. Such an arrangement would cause container 1 to attempt to rotate only slightly away from vertical axis 20. Therefore, the natural balance of container 1 when a user is using pouring handle 14 is such that the container balance is approximately correct for filling either a gas tank with a vertical filler neck 16 or a gas tank with an inclined filler neck 15. Thus, a user is not constantly struggling to balance container 1 during a pouring operation. Further, maintaining the balance of container 1 closely adjacent to vertical axes 18 or 20 allows an easier view of back wall 11 and the pour spout during a pouring operation.

Figures 4, 5, 6:
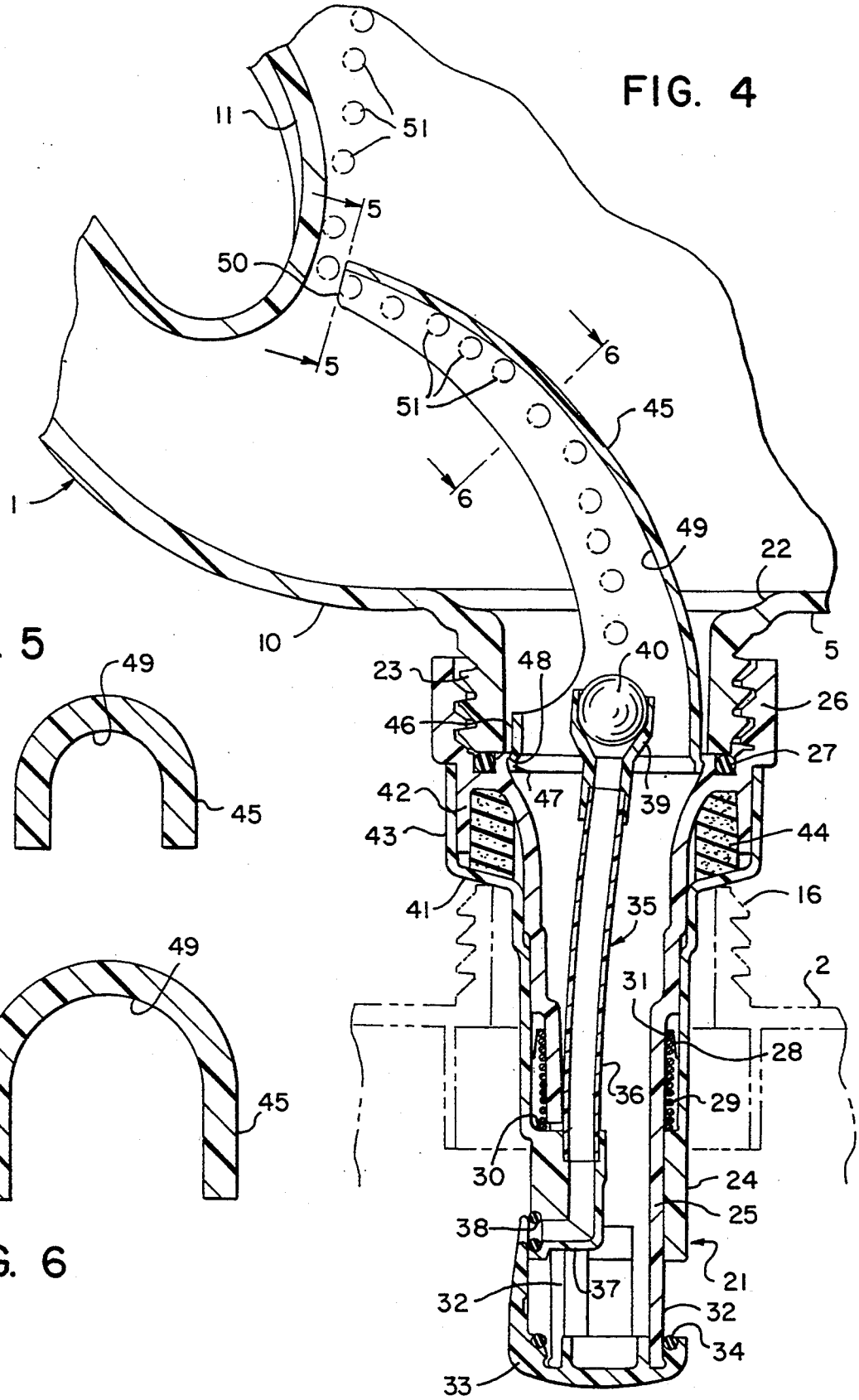
FIG. 4 is an enlarged fragmentary cross-sectional view of the pour spout and bubble deflector.
FIG. 5 is a cross-sectional view of the bubble deflector taken along the plane of the line 5—5 in FIG. 4.
FIG. 6 is a cross-sectional view of the bubble deflector taken along the plane of the line 6—6 in FIG. 4.

Referring now to FIG. 4, there is illustrated a pour spout generally designated by the numeral 21 for dispensing liquid from container 1 to tank 2. Container 1 includes an outlet 22 in front wall 5 defining a discharge opening for discharging liquid from container 1 or for filling container 1 with the liquid to be stored and/or transported. An annular neck 23 is disposed about outlet 22 for connecting pour spout 21 to container 1. As illustrated, spout 21 includes a generally cylindrical fuel conduit 24 and a cylindrical sleeve 25 is mounted for sliding movement within conduit 24. One end of sleeve 25 is provided with a threaded cap 26 which is adapted to be threaded to neck 23 of container 1. A suitable resilient gasket or seal 27 seals the threaded connection between cap 26 and neck 23, as seen in FIG. 4. The annular space, or clearance, between sleeve 25 and conduit 24 is sealed by a flexible lip 28 on sleeve 25 that bears against the inner surface of conduit 24. Sleeve 24 is biased to a closed position by a spring 29. One end of spring 29 bears against an internal ledge 30 on the outer or distal end of conduit 24 while the opposite end of spring 29 is engaged with a seat 31 on seal 28.

The outer or distal end of sleeve 25 is provided with a series of longitudinally extending legs 32 which carry a closure or valve 33. The spaces between legs 32 provide discharge openings for the fuel when valve 33 is opened (see FIG. 4). Valve 33 is provided with an O-ring seal 34 so that when valve 33 is in a closed position (see FIG. 1) O-ring 34 provides a seal against the lower edge of conduit 24 to prevent the flow of fuel from conduit 24.

Mounted within sleeve 25 is a vent tube 35 which includes a longitudinal section 36 and a radial section 37 which terminates in an inlet port 38. As shown in FIG. 4, the axis of inlet port 38 faces radially and the inlet port communicates with the interior of tank 2 when valve 33 is open. A check valve is associated with vent tube 35 which permits the flow of vapor and air from tank 2 through vent tube 35 to container 1 but prevents the flow of liquid or fuel in the opposite direction. As shown in FIG. 4, the check valve includes a valve seat 39 which is connected to the inner end of vent tube 35 and a ball 40 adapted to engage seat 39. Thus, with ball 40 engaged in seat 39, flow of liquid through vent tube 35 is prevented. Secured to seat 39 are a plurality of inwardly extending lips (not shown) which prevent ball 40 from being completely dislodged from seat 39. As a result, when liquid or fuel is poured from container 1 through spout 21 into tank 2 a partial vacuum will be created in container 1, and the pressure differential between container 1 and tank 2 will unseat ball 40 upwardly from seat 39 so that the fuel vapor and air from tank 2 will then be vented to container 1. Pour spout 21 also includes a collar 41 integral with conduit 24 that projects radially therefrom to form an annular wall for engaging the upper edge of neck 16 of tank 2. The annular space or clearance between sleeve 25 and conduit 24 beneath cap 26 is sealed to prevent the entry of foreign material such as dirt, sand or the like into the sliding interface formed between conduit 24 and sleeve 25. This seal is provided by an annular skirt 42 depending from cap 26 which overlaps with the upper edge of an upstanding annular flange 43 projecting from the outer end of collar 41. Skirt 42 and flange 43 form a tortuous path that effectively prevents the entry of foreign material. In addition to skirt 42 and flange 43, the seal may incorporate an annular jacket 44 of resilient foam material that surrounds sleeve 25 and functions as a filter for any particulate matter that may pass through the tortuous path formed by skirt 42 and flange 43. Jacket 44 may be formed of a polyethylene open cell foam material that has sufficient resiliency in the axial direction to permit compression and recovery from such deformation to its original shape.

In operation, spout 21 is introduced into tank neck 16 until collar 41 engages the outer edge of neck 16. Continued downward movement of container 1 will cause sleeve 25 to move downward relative to conduit 24 to open valve 33 and permit fuel to flow through sleeve 25 into tank 2. As tank 2 is filled with fuel, air and vapor within tank 2 will be vented upwardly through vent tube 35 and around ball 40 into container 1. When the level of liquid in tank 2 reaches the inlet port 38 in vent tube 35, the flow of fuel will cease. Spout 21 can then be withdrawn from tank 2 and spring 29 will force sleeve 25 and valve 33 to the closed position to seal conduit 24 and prevent further flow of liquid from conduit 24.

In order for a user to determine when tank 2 is full and thus the flow of liquid into tank 2 has stopped, pour spout 21 includes a bubble deflector 45 connected to the upper end of sleeve 25 within cap 26. Deflector 45 functions to capture any air and vapor displaced from within tank 2 into container 1 through vent tube 35 and direct this air and vapor to a location adjacent a wall of container 1. To this end, deflector 45 includes a mounting collar 46 for releasably mounting deflector 45 in a snap-fit arrangement with the upper end of sleeve 25. Collar 46 includes an annular bead 47 along its edge which cooperates with an inwardly extending annular lip 48 located at the upper edge of sleeve 25 adjacent gasket 27. Since sleeve 25 and deflector 45 are both made of plastic material bead 47 easily fits within lip 48 in a snap-fit arrangement. Deflector 45 has an elongate, arcuate shaped body with a U-shaped cross-section. As shown best in FIGS. 5 and 6, the U-shaped cross-section of deflector 45 converges toward the free end thereof. Thus, deflector 45 defines a channel 49 which becomes narrower as it progresses toward free end 50, so that any air and vapor is collected and concentrated as it leaves free end 50.

As shown best in FIG. 4, free end 50 is located closely adjacent to back wall 11 of the structure connecting carrying handle 9 to top wall 3 of container 1. As a result, air and vapor leaving free end 50 passes closely adjacent to back wall 11 during its travel through the liquid contained within container 1.

In order for a user to visually determine when the flow of liquid ceases through spout 21 into tank 2, a window is formed in a wall of container 1 which provides a sufficient level of light transmittal therethrough to permit the displacement of the air and vapor bubbles 51 to be visually observed therethrough by a user. Accordingly, when container 1 is formed of a plastic such as polypropylene, polyethylene or fiber-filled nylon, its walls may be sufficiently transparent or translucent throughout the reservoir body so that the liquid therein and the bubbles 51 can be observed through its walls. Under such circumstances, the "window" would comprise back wall 11 of container 1. If, however, container 1 was composed of an opaque material, a sight gauge or window such as that shown in FIGS. 7 and 8 may be necessary in order to visually observe bubbles 51. As shown in FIG. 7, this window may comprise a wall having a thinned or narrow portion 52 adjacent free end 50 of deflector 45 which would enable a user to observe when the bubbles 51 stop. Alternately, FIG. 8 illustrates a different type of sight glass or window having a transparent pane 53 mounted in wall 11 adjacent free end 50 of deflector 45. Pane 53 may be integrally molded with wall 11, and composed of transparent material. Thus, when a user is transferring liquid from container 1 to tank 2, the user can visually observe through the window when tank 2 is full since bubbles 51 will stop when the level of liquid in tank 2 is above the distal end of spout 21, as hereinbefore described. The user may then withdraw spout 21 from neck 16 of tank 2.

Various modes of carrying out the invention are contemplated as being within the scope of the following claims particularly pointing out and distinctly claiming the subject matter regarded as the invention.

We claim:

1. A portable container for transporting, storing and dispensing a liquid comprising:

a hollow reservoir housing defining a compartment for containing a liquid, said hollow reservoir housing having at least one wall;

an outlet defining a discharge opening in said housing for discharging liquid therefrom;

a window formed in said at least one wall providing a sufficient level of light transmittal therethrough to permit the displacement of air bubbles in said reservoir housing to be visually determined by observation through said window;

a pour spout releasably attached to said outlet for conducting liquid from said housing;

valve means associated with said pour spout movable to an open position during a pouring operation for dispensing said liquid and for automatically shutting off while in said open position to stop dispensing said liquid, said valve means includes a vent passage disposed in said pour spout having an inlet end opening exteriorly of said pour spout and an outlet end opening interiorly of said housing, and a check valve disposed in said vent passage for permitting the flow of air through said vent passage into said housing and preventing fluid flow through said vent passage in the opposite direction during a pouring operation; and an air bubble deflector connected to said pour spout and extending into the interior of said compartment for directing air entering said housing during a pouring operation to a location adjacent said window.

2. The container of claim 1 wherein said housing is molded from a plastic having a wall thickness and density with a low-level of light transmittal such that air bubbles displaced therein may not be normally determined visually by observation through said at least one wall, and said window is integrally molded in said at least one wall, and said window being a sufficiently thin section of said at least one wall in order to provide visual observation through said thin wall section.

3. The container of claim 1 wherein said housing is molded from a plastic having a wall thickness and density providing a sufficient level of light transmittal therethrough such that air bubbles displaced therein may be visually observed through said at least one wall, and said window is a portion of said at least one wall.

4. The container of claim 1 wherein said window comprises a transparent pane mounted in said at least one wall.

5. The container of claim 1 wherein said reservoir housing is of a ventless type such that air is displaced only through said outlet.

6. The container of claim 1 wherein said bubble deflector has an elongate, arcuate-shape body.

7. The container of claim 6 wherein said bubble deflector has a U-shaped cross section.

8. The container of claim 1 wherein said bubble deflector and said pour spout are connected by means of a snap-fit connection.

9. The container of claim 1 wherein said reservoir housing includes a carrying handle having forward and rearward ends connected to said reservoir housing.

10. The container of claim 9 wherein the connection of the forward end of said handle to said reservoir housing comprises a tapered forward wall, a tapered back wall and pair of opposite tapered end walls all converging at the forward end of said handle, and said window is formed in said back wall.

11. The container of claim 9 further including a pouring handle having upper and lower ends connected to said reservoir housing.

12. The container of claim 11 wherein said reservoir housing includes a top wall, a bottom wall, a front wall, a rear wall and pair of opposite side walls defining said compartment, and said carrying handle is connected to said top wall and said pouring handle is connected to said rear wall.

13. The container of claim 12 wherein said reservoir housing has a center of gravity and said center of gravity is located closely adjacent to a vertical line passing through said pouring handle during a pouring operation.

14. A portable container for transporting, storing and dispensing a liquid comprising:

a hollow reservoir housing defining a compartment for containing a liquid, said housing having at least one wall molded from a plastic having a wall thickness and density providing a sufficient level of light transmittal therethrough such that air bubbles displaced therein may be visually observed through said at least one wall;

an outlet defining a discharge opening in said housing for discharging liquid therefrom;

a pour spout releasably attached to said outlet for conducting liquid from said housing;

valve means associated with said pour spout movable to an open position during a pouring operation for dispensing said liquid and for automatically shutting off while in said open position to stop dispensing said liquid, said valve means includes a vent passage disposed in said pour spout having an inlet end opening exteriorly of said pour spout and an outlet end opening interiorly of said housing, and a check valve disposed in said vent passage for permitting the flow of air through said vent passage into said housing and preventing fluid flow through said vent passage in the opposite direction during a pouring operation; and an air bubble deflector connected to said pour spout and extending into the interior of said compartment for directing air entering said housing during a pouring operation to a location adjacent said at least one wall.

15. The container of claim 14 wherein said reservoir housing is of a ventless type such that air is displaced only through said outlet.

16. The container of claim 14 wherein said bubble deflector has an elongate, arcuate-shape body.

17. The container of claim 16 wherein said bubble deflector has a U-shaped cross section.

18. The container of claim 14 wherein said bubble deflector and said pour spout are connected by means of a snap-fit connection.

19. The container of claim 14 wherein said reservoir housing includes a carrying handle having forward and rearward ends connected to said reservoir housing, and wherein the connection of the forward end of said handle to said reservoir housing comprises a tapered forward wall, a tapered back wall and pair of opposite tapered end walls all converging at the forward end of said handle, and said air bubble deflector is positioned to direct air adjacent said tapered back wall.

20. A portable container for transporting, storing and dispensing a liquid comprising:

a hollow reservoir housing having at least one wall defining a compartment for containing a liquid, said at least one wall includes a top wall, a bottom wall, a front wall, a rear wall and pair of opposite side walls defining said compartment, a carrying handle having forward and rearward ends connected to the top wall of said reservoir housing, a pouring handle having upper and lower ends connected to the rear wall of said reservoir housing;

an outlet defining a discharge opening in said housing for discharging liquid therefrom;

a window formed in said at least one wall providing a sufficient level of light transmittal therethrough to permit the displacement of air bubbles in said reservoir housing to be visually determined by observation through said window;

a pour spout releasably attached in said outlet for conducting liquid from said housing;

valve means associated with said pour spout movable to an open position during a pouring operation for dispensing said liquid and for automatically shutting off while in said open position to stop dispensing said liquid, said valve means includes a vent passage disposed in said pour spout having an inlet end opening exteriorly of said pour spout and an outlet end opening interiorly of said housing, and a check valve disposed in said vent passage for permitting the flow of air through said vent passage into said housing and preventing fluid flow through said vent passage into the opposite direction during a pouring operation;

an air bubble deflector connected to said pour spout and extending into the interior of said compartment for directing air entering said housing during a pouring operation to a location adjacent said window; and said reservoir housing has a center gravity and said center of gravity is located closely adjacent to a vertical line passing through said pouring handle during a pouring operation.

21. The container of claim 20 wherein said reservoir housing is of a ventless type such that air is displaced only through said outlet.

* * * * *